US008038467B2

(12) United States Patent
Shen et al.

(10) Patent No.: US 8,038,467 B2
(45) Date of Patent: Oct. 18, 2011

(54) CONNECTOR HAVING THREE-WAY INTERCONNECTION

(75) Inventors: Guo-Jian Shen, Kunshan (CN); Chi Zhang, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/616,707

(22) Filed: Nov. 11, 2009

(65) Prior Publication Data

US 2010/0120280 A1 May 13, 2010

(30) Foreign Application Priority Data

Nov. 11, 2008 (CN) ..... 2008 2 0217798

(51) Int. Cl.
*H01R 12/24* (2006.01)

(52) U.S. Cl. ..... 439/495; 439/260; 439/326

(58) Field of Classification Search ..... 439/260, 439/329, 495
See application file for complete search history.

(56) References Cited

U.S. PATENT DOCUMENTS 5,501,610 A * 3/1996 Ikemoto ..... 439/498
5,738,545 A 4/1998 Igarashi et al.
5,928,027 A * 7/1999 Kunishi ..... 439/495
6,155,868 A * 12/2000 Wu et al. ..... 439/495
6,250,966 B1 * 6/2001 Hashimoto et al. ..... 439/631
6,520,797 B2 * 2/2003 Okamura et al. ..... 439/495
6,527,595 B1 3/2003 Watanabe
6,755,682 B2 6/2004 Kunishi et al.
7,083,454 B2 * 8/2006 Suzuki ..... 439/260
7,494,366 B2 * 2/2009 Suzuki et al. ..... 439/495

* cited by examiner

*Primary Examiner* — Truc Nguyen
(74) *Attorney, Agent, or Firm* — Andrew C. Cheng; Wei Te Chung; Ming Chieh Chang

(57) ABSTRACT

An electrical connector (100) for electrically mating with two different mating interfaces includes an insulative housing (1) defining a first and a second mating spaces (114, 124) located at opposite ends, a plurality of contact terminals (2) received in the insulative housing (1) each of which integrally defines an upper beam (2*a*), a lower beam (2*b*), and a fulcrum portion (21) connecting the beams at middle thereof, an actuator (4) pivotally assembled on the housing (1) and capable of rotating between an opened position in which one of the mating spaces (124) is accessible, and a closed position in which the actuator (4) is substantially covering said mating space (124). Each contact terminal (2) forms a first contact portion (221, 231) extending toward a first mating space (114) from the fulcrum portion (21), a second contact portion (251) extending toward a second mating space (124) from the fulcrum portion (21), and a soldered portion (252) solderable onto a PCB (400) which the electrical connector (100) located thereon or therein.

19 Claims, 6 Drawing Sheets

CONNECTOR HAVING THREE-WAY INTERCONNECTION

BACKGROUND OF THE INVENTION

1. Field of the Invention

The present invention relates to an adaptor, and more particularly, to a connector having an FPC interface at one end, and a mating interface at the other end.

2. Description of the Related Art

FPC is a medium used for data transmission between computers and the peripherals connected thereto. U.S. Pat. No. 6,755,682 issued to Kunishi et al. on Jun. 29, 2004, discloses a conventional FPC connector which includes an insulative housing forming a receiving recess for receiving an inserted FPC, a plurality of terminals which are arranged across a width thereof and with a contacting portion protruding into the receiving recess. An actuator is pivotally movable relative to the housing and can be operated between an opened position at which the FPC is permitted to insert into the receiving recess and a closed position at which said FPC is pressed against with the contacting portion of the terminal. This typical FPC connector is normally soldered onto a printed circuit board, and with its mating interface to receive an FPC therein. However, when we need mate an FPC and another mating connector, we would use additional numbers of connectors that would occupy more area on the PCB.

U.S. Pat. No. 5,738,545 issued to Igarashi et al. on Apr. 14, 1998, discloses a conventional connection device or interconnecting with an FPC and a mating connector mounted on a Printed Circuit Board (PCB). More particularly, the connection device is used for an electrical adapter between of the FPC and the mating connector. However, the connection device could only be interconnected between the FPC and the mating connector which is not easily modified to apply in another field application, for example another connection device which could create an interconnection between the PCB and at least one of the different interfaces.

Therefore, an improved electrical connector is desired to overcome the disadvantages of the related arts.

SUMMARY OF THE INVENTION

An object of the present invention is to provide an electrical connector which is soldered to a PCB and electrically connecting with two different interfaces for transmitting signals between the PCB and at least one of the objects.

In order to achieve the above-mentioned object, an electrical connector for electrically mating with two different mating interfaces in accordance with a preferred embodiment of the present invention includes an insulative housing defining a first and a second mating spaces located at opposite ends, a plurality of contact terminals received in the insulative housing each of which integrally defines an upper beam, a lower beam, and a fulcrum portion connecting the beams at middle thereof, an actuator pivotally assembled on the housing and capable of rotating between an opened position in which one of the mating spaces is accessible, and a closed position in which the actuator is substantially covering said mating space. Each contact terminal forms a first contact portion extending toward a first mating space from the fulcrum portion, a second contact portion extending toward a second mating space from the fulcrum portion, and a soldered portion solderable onto a PCB which the electrical connector located thereon or therein.

Other objects, advantages and novel features of the invention will become more apparent from the following detailed description of the present embodiment when taken in conjunction with the accompanying drawings.

DETAILED DESCRIPTION OF THE INVENTION

Figure 1:
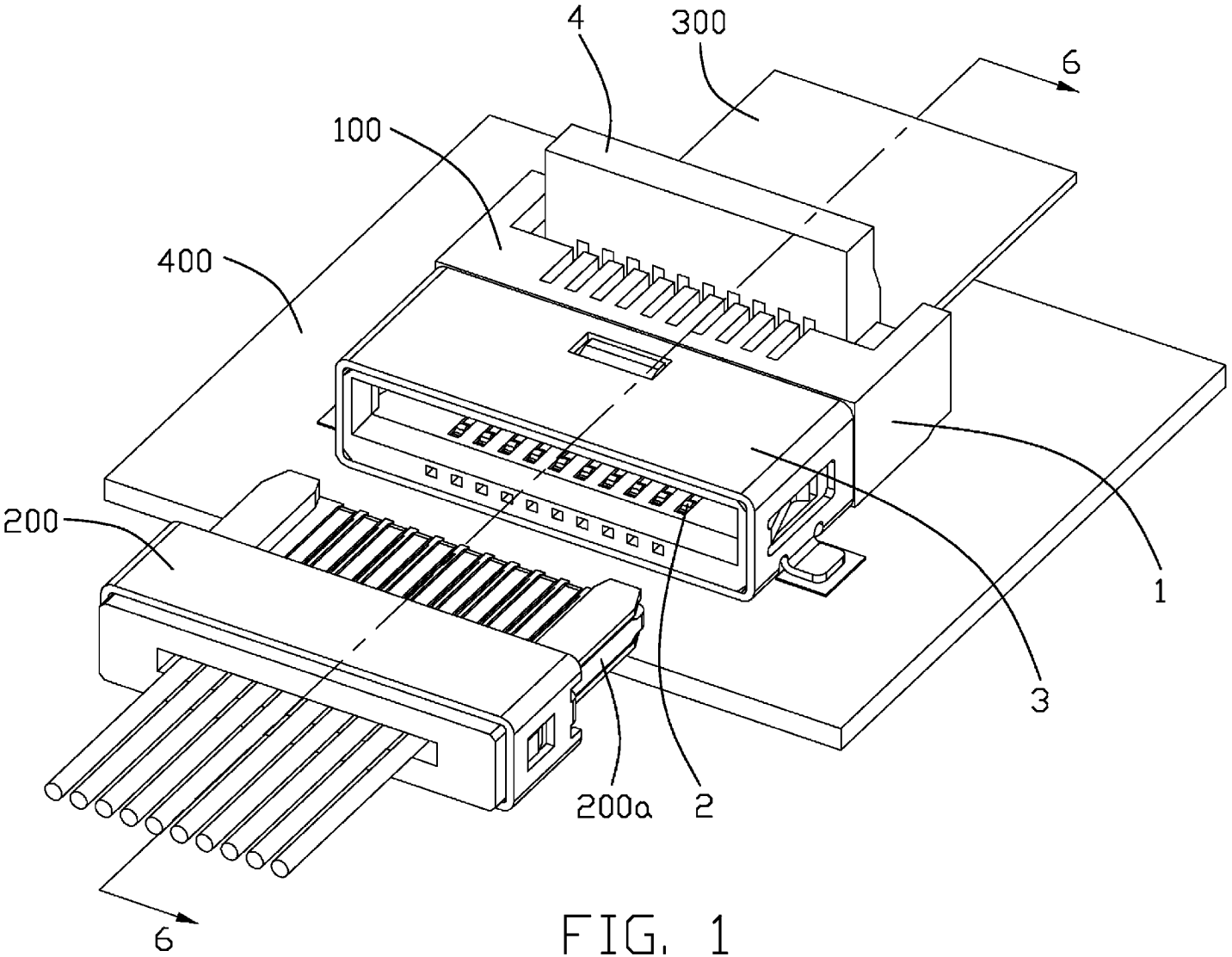
FIG. 1 is a perspective view of an electrical connector in accordance with the preferred embodiment of the present invention which is located on a PCB to connect with an FPC and a plug connector.

Reference will now be made to the drawing figures to describe the preferred embodiment of the present invention in detail.

Figure 2:
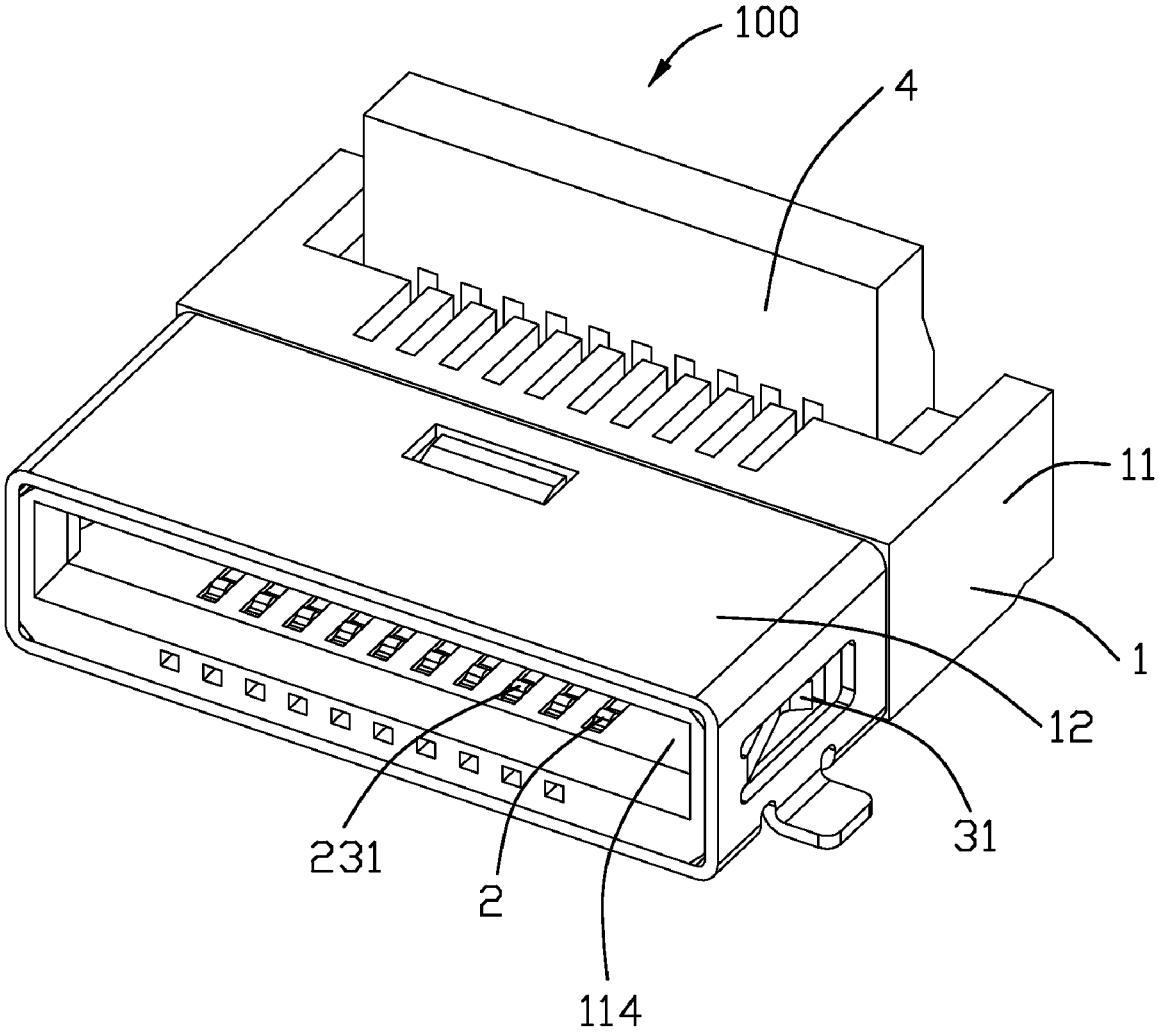
FIG. 2 is a perspective view of the electrical connector of FIG. 1.

Referring to FIGS. 1 and 2, an electrical connector 100 can electrically mate with a mating connector 200 and an FPC (flexible circuit board) 300 by separate mating ports, and includes an insulative housing 1 formed with a first mating portion 11 (i.e. a frist mating interface) and a second mating portion 12 (i.e. a second mating interface) located at opposite ends thereof and in communicated with the first mating portion 11.

Figure 3:
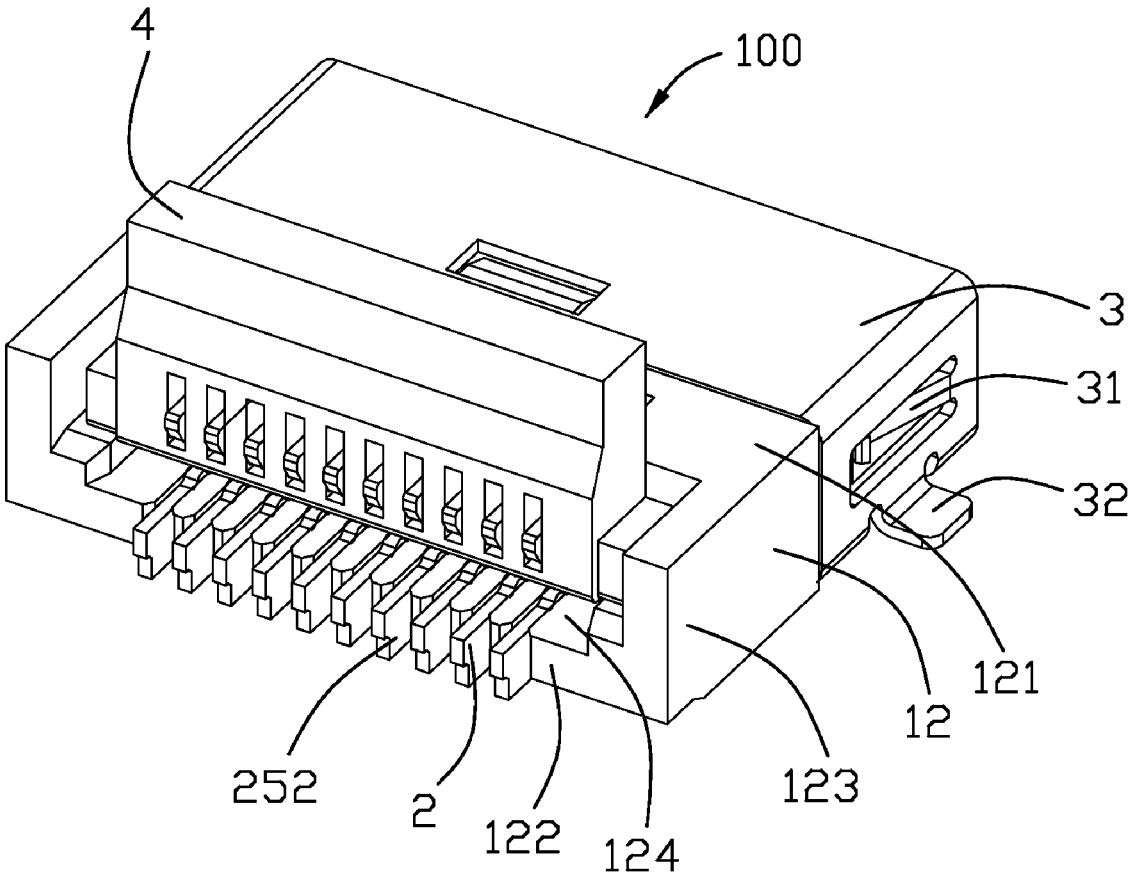
FIG. 3 is another perspective view of the electrical connector of FIG. 1.
Figure 4:
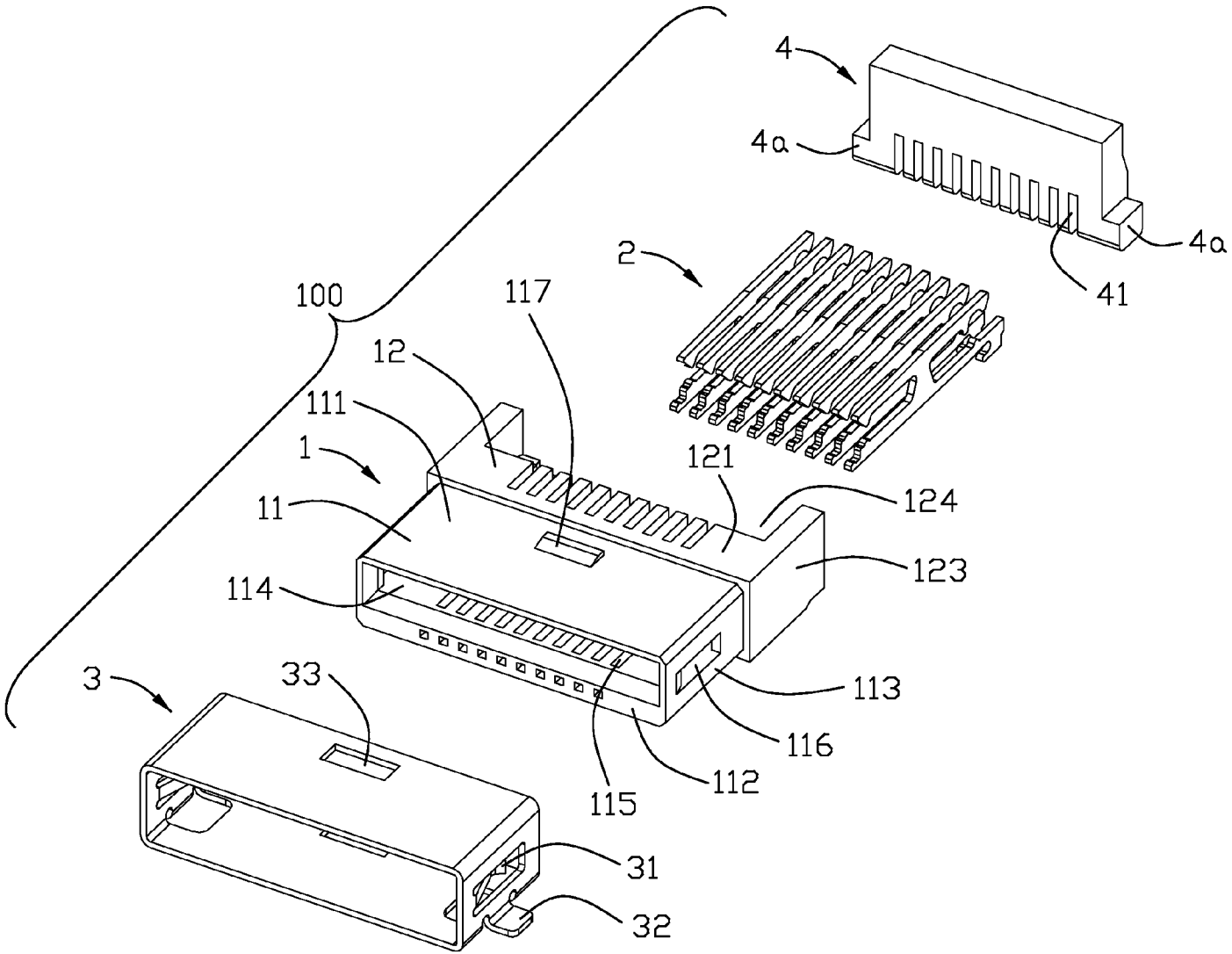
FIG. 4 is an exploded view of the electrical connector of FIG. 2.

Referring to FIGS. 3 and 4, the first mating portion 11 forms a mating port 114 (i.e. a first mating space) surrounded by a pair of first side walls 111, 112 and a pair of first end walls 113 integrally connected with both ends of the first side walls 111, 112 for receiving the mating connector 200. The second mating portion 12 forms a recess 124 (i.e. a second mating space) formed by a pair of second side walls 121, 122 and a pair of second side walls 123 in communicating with ends of the second side walls 121, 122 for accepting the FPC 300. The electrical connector 100 is assembled on a PCB 400, thereby the insulative housing 10 is laid on the PCB 400. The first side walls 111, 112 define a plurality of grooves 115 extending through the second side walls 121, 122 and in communicating with the mating port 114 and the recess 124. A plurality of terminals 2 are inserted into the corresponding grooves 115 and received and retained therein from a side that the second mating portion 12 located.

Figure 5:
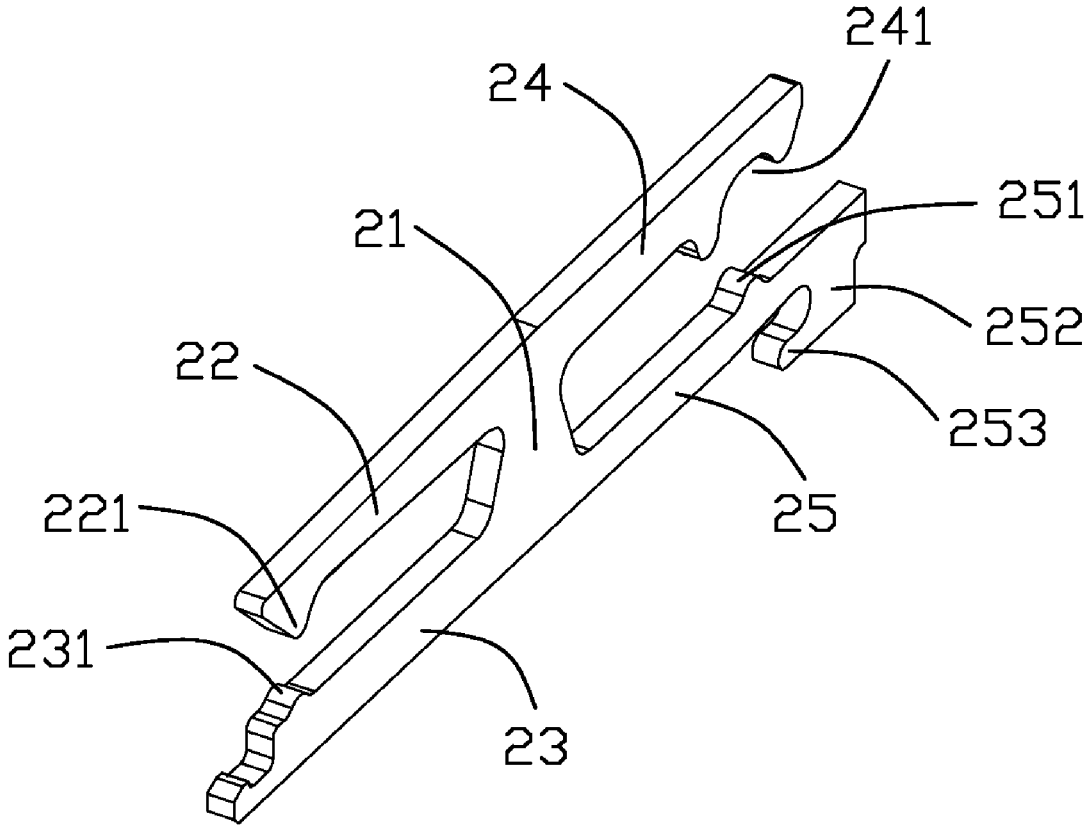
FIG. 5 is a perspective view of a terminal of the electrical connector.
Figure 6:
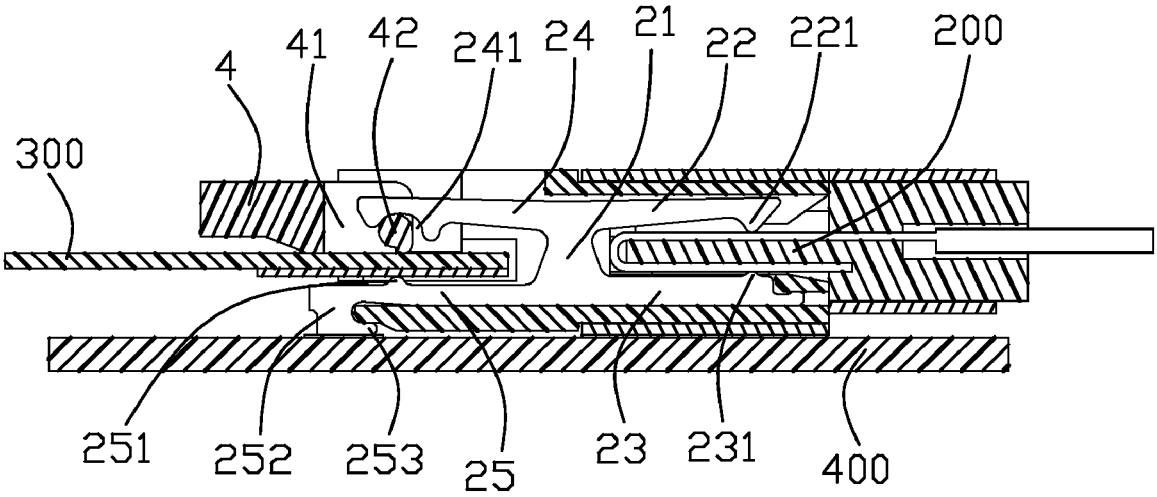
FIG. 6 is a cross-section of the electrical connector taken along line 6-6 of FIG. 1, which is soldered onto the PCB and mates with the plug connector and the FPC.

Referring to FIGS. 4 to 6, each terminal 2 integrally includes an upper beam 2*a* retained in the upper side walls 111, 121, a lower beam 2*b* received in the lower side walls 112, 122 and a fulcrum portion 21 connecting the upper beam 2*a* and the lower beam 2*b* at middle thereof, thereby the terminal 2 forms substantially a horizontal H-shaped configuration. The terminal 2 forms a pair of first contacting arms 22, 23 both extending forwards into the mating port 114 from both end of the fulcrum portion 21. One first contacting arm 22 of the upper beam 2*a* has a first engaging portion 221 at front end thereof, and is opposite to a first contacting portion 231 defined by another first contacting arm 23 at front end thereof. The first engaging portion 221 and the first contacting portion 231 are protruded into the mating port 114, thereby the mating connector 200 that plugged into the mating port 114 is sandwiched between the first contact portion 231 and first engaging portion 221 for establishing electrical connection of two connectors 100, 200.

The terminal 2 further defines a pivot arm 24 and a second contacting arm 25 both extending rearwards into the recess 124 from both end of the fulcrum portion 21. The second contacting arm 25 includes a second contacting portion 251 protruded into the recess 124 from the groove 115 of the side wall 122 and a soldered portion 252 extending outwards and solderable onto the PCB 400 from the second contacting portion 251. The soldered portion 252 defines a barb 253 for securely holding the second side wall 122. The pivot arm 24 of the upper beam 2*a* defines a cam receiving portion 241 at rear end thereof.

The electrical connector 100 further includes an actuator 4 pivotally assembled on the housing 1 and terminal 2 and capable of rotating between an opened position, in which the recess 124 is accessible to receive the FPC therein, and a closed position in which the actuator 4 is substantially covering said recess 124 to depress the received FPC 300 toward the second contacting portion 251 of the terminal 2. The actuator 4 defines a pair of axis 4*a* moveably assembled on the both ends of the insulative housing 1, a plurality of holes 41 for receiving the pivot arm 24 and a plurality of cam portion 42 formed by the holes 41 and outer edge of the actuator 4 received in and engaging with the cam receiving portion 241 of the pivot arm 24. The cam receiving portion 241 is double-hump-shaped configuration for preventing the cam portion 42 of the actuator 4 received therein away from its intended position. When the actuator 4 moves to the closed position, it could press the FPC 300 inserted in the recess 124 downwards against the second contacting portion 251 of the terminal 2 for electrically connecting the electrical connector 100 with the FPC 300.

Along with the actuator 4 rotates between the opened position and closed position, the upper beam 2could be also movable or stationary relative to the lower beam 2*b*. If the upper beam 2*a* is moveable, the first contact portion 231 and first engaging portion 221 could securely sandwich the mating connector 200 after the first engaging portion 221 moves downwards as upward movement of the pivot arm 24 pressed by the cam portion 42 of the actuator 4. The mating connector 200 is plugged in the mating port 114 as a lower inserting force (LIF) when the upper beam 2*a* is stationary relative to the lower beam 2*b*. The electrical connector 100 with two different interfaces establishes a three-way interconnection of between the PCB 400 and at least one of the mating connector 200 and the FPC 300. It may be noted that an effective mechanical and electrical connection between the mating connector 200 and the terminal 2 is primarily derived from an inward deflection of the first contact arm 22 around the first mating portion 11, due to the actuator's movement from the opened position to the closed position.

The electrical connector 100 further includes a metallic shell 3 shrouding the mating port 114 for preventing the electrical connector 100, especially the first mating portion 11 from EMI. The metallic shell is provided with a plurality of retaining holes 33 for securely holding with a plurality of protruding tuber 117 of the first side walls 111, 112. The metallic shell 3 defines a pair of resilient finger 31 extending inwards along a front-to-rear direction in which the mating connector 200 is plugged into the mating port 114, and a pair of pads 32 at both ends thereof solderable onto said PCB 400 for forming a grounding trace. The end wall 113 includes a window 116 for extension of the resilient finger 31 therethrough to the mating port 114, thereby the shell could electrically connecting with a pair of grounding terminals 200*a* of the mating connector 200.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An interconnection system comprising:

an electrical connector forming a first and a second mating spaces at both ends thereof and comprising an insulative housing and a plurality of terminals retained in the housing, each of which integrally defining a first contacting portion and a second contacting portion respectively extending into the first and the second mating spaces;

the electrical connector further comprising an actuator pivotally assembled on a front side in which the second mating space disposed and capable of rotating between an opened position in which a flexible printed circuit board is permitted inserted into the second mating spaces, and a closed position in which the actuator is substantially closing-in the second mating space and pressing the flexible printed circuit board downwards against the second contacting portion of the terminal; and wherein a mating connector plugged into the first mating space and comprising an insulative housing, a plurality of contacting terminals retained in the insulative housing and electrically connecting with the first contacting portion; and the flexible circuit board is received in the second mating space and comprises a plurality of electronic pads disposed thereunder which are depressed by the actuator to contact with the second contacting portion;

the thickness of the flexible circuit board is smaller than the mating connector;

wherein the terminal further including a soldering portion extending beyond the insulative housing for electrically mounting onto a printed circuit board.

2. The interconnection system as described in claim 1, wherein each terminal integrally comprise an upper beam, a lower beam, and a fulcrum portion connecting the upper beam and the lower beam at middle thereof, thereby forms a horizontal H-shaped configuration.

3. The interconnection system as described in claim 2, wherein the upper beam is stationary relative to the lower beam.

4. The interconnection system as described in claim 2, wherein the upper beam is moveable relative to the lower beam.

5. The interconnection system as described in claim 2, wherein the upper beam comprises a cam receiving portion at one end thereof engaging with a cam portion of the actuator received therein.

6. The interconnection system as described in claim 2, wherein the cam receiving portion is double-hump-shaped configuration, the cam portion of the actuator is received therein.

7. An electrical connector assembly comprising:

an electrical connector defining opposite first and second mating ports;

a plurality of contacts disposed in the housing, each of said contacts defining a pivotal arm with a fulcrum at a middle region and opposite first and second end sections respectively extending into the first and second mating ports so as to perform substantially a lever function essentially pivotal about said fulcrum;

an actuator mounted to the housing around the second mating port to cooperate with the second end section, between an open position, where the pivotal arm is in a relatively relaxed manner, and a closed position, wherein the pivotal arm is in a relatively tensioned manner;

an Flexible Printed Circuit inserted into the second mating port and tightly abutting against and electrically connecting the contact around the second end section when said actuator is located in the closed position;

and an electronic part inserted into the first mating port and tightly abutting against and electrically connecting to the contact around the first end section when said actuator is located in the closed position; wherein an effective mechanical and electrical connection between the electronic part and the contact is primarily derived from an inward deflection of the pivotal arm around the first mating port, due to the actuator's movement from the open position to the closed position;

wherein the contact further including a soldering portion extending beyond the insulative housing for electrically mounting onto a printed circuit board.

8. The electrical connector assembly as claimed in claim 7, wherein each of said contacts further includes a mounted section around a mounting face for securing to a printed circuit board on which said mounting face is seated.

9. The electrical connector assembly as claimed in claim 7, wherein the FPC directly electrically and mechanically connects to a position of another arm of the contact when the actuator is located in the closed position, said another arm being essentially parallel to the pivotal arm.

10. The electrical connector assembly as claimed in claim 9, wherein the FPC is not directly mechanically and electrically connected to the pivotal arm when the actuator is located in the closed position.

11. The electrical connector assembly as claimed in claim 9, wherein the electrical part is directly mechanically and electrically connected to at least one of said pivotal arm and said another arm when the actuator is located in the closed position.

12. The electrical connector assembly as claimed in claim 7, wherein the contact further includes another arm linked with the fulcrum, and the actuator is located between the pivotal arm and said another arm under condition that the FPC is directly mechanically and electrically connected to only one of said pivotal arm and said another arm.

13. The electrical connector assembly as claimed in claim 7, wherein said actuator is moveable in a rotational manner to actuate the corresponding pivotal arm.

14. An electrical connector mounted on a printed circuit board featuring first and second interfaces, comprising:

an insulative housing having a mounting surface, a first interface disposed at rear side thereof, a second interface formed with a flat printed circuit (FPC) insertion slot and disposed opposite and different to the first interface;

a plurality of contact terminals loaded within said insulative housing in parallel relationship with a predetermined pitch, each contact terminal including a soldering portion extending beyond the mounting surface for electrically mounting onto a printed circuit board, a first contact contacting portion arranged at the first interface, and a second contacting portion arranged at the second interface;

an actuator pivotably arranged adjacent to the second contacting portion for establishing contact between conductors of said FPC and said terminals, each of contact terminal at front side thereof having a second contacting beam extending into said FPC insertion slot and a pivot beam extending substantially parallel in the upper side of said second contacting beam, a cut-out portion being formed on a lower edge at a tip end portion of said pivot beam for forming a cam pivot portion of the terminals, said actuator being formed with through holes corresponding to the cam pivot portions of respective terminals, a peripheral edge portion of each of said through holes being formed into a cam portion to engage with said cam pivot portion, and pushing projecting portions being provided between adjacent cam portions and between said contact beams of the terminals for pivoting according to pivot motion of said actuator for engaging and urging said FPC toward said contact beams of said terminals; and a metal shell shrouded to the first mating interface and having at least a solder pad disposed on the mounting surface; and wherein the first contacting portion electrically contacting the mating connector; and wherein the second contacting portion electrically contacting the flat printed circuit; and wherein each contact terminal forms a horizontal H-shaped configuration.

15. The electrical connector as described in claim 14, wherein the actuator comprises a pair of axis moveably assembled on the both ends of the flat printed circuit (FPC) insertion slot.

16. The electrical connector as described in claim 14, wherein the contact terminal at rear side thereof comprises a pair of first contacting beams extending into a mating port formed by the first interface and substantially parallel to each other.

17. The electrical connector as described in claim 16, wherein the upper first contacting beam is moveable relative to the lower first contacting beam.

18. The electrical connector as described in claim 14, wherein the soldering portion extends outwards from the second contacting beam.

19. The electrical connector as described in claim 14, wherein the metallic shell retains with the insulative housing and further comprises at least one of resilient finger extending inwards the first mating interface.

* * * * *